US005249690A

United States Patent [19]

Patterson

[11] Patent Number: 5,249,690

[45] Date of Patent: Oct. 5, 1993

[54] APPARATUS AND METHOD FOR SORTING COMMINGLED WASTE MATERIALS FOR RECYCLING

[76] Inventor: Gill R. Patterson, 31801 National Park Dr., Laguna Niguel, Calif. 92677

[21] Appl. No.: 763,308

[22] Filed: Oct. 15, 1991

[51] Int. Cl.[5] ..... B07C 7/00

[52] U.S. Cl. ..... 209/630; 209/703; 209/705; 209/930; 209/942; 198/365; 198/366; 198/370

[58] Field of Search ..... 209/12, 629, 702, 703, 209/704, 705, 930, 937, 942; 198/362, 365, 366, 367.2, 370, 442

[56] References Cited

U.S. PATENT DOCUMENTS

| | | | |
|---|---|---|---|
| 1,616,693 | 2/1927 | Havigharst | 209/705 X |
| 2,183,884 | 12/1939 | Hait | 209/705 X |
| 2,856,071 | 10/1958 | Williamson | 209/705 |
| 3,651,940 | 3/1972 | Rooke | 209/705 |
| 3,804,248 | 4/1974 | Talamantz | 209/930 X |
| 4,239,435 | 12/1980 | Weiss et al. | 209/937 X |
| 4,763,793 | 8/1988 | Stehle et al. | 209/704 X |
| 5,101,977 | 4/1992 | Roman | 209/12 X |

FOREIGN PATENT DOCUMENTS

| | | | |
|---|---|---|---|
| 1147653 | 3/1985 | U.S.S.R. | 209/705 |

*Primary Examiner*—Joseph E. Valenza
*Assistant Examiner*—Tuan N. Nguyen
*Attorney, Agent, or Firm*—Francis X. LoJacono

[57] ABSTRACT

An apparatus and method of selectively sorting commingled recyclable waste materials wherein the waste materials are continuously fed to a primary conveyor unit having a primary sorting conveyor and a primary return conveyor. A plurality of sorting stations having a plurality of sorting chutes are positioned along the primary sorting conveyor so that designated waste materials are selectively removed and deposited into the respective designated chutes, whereby the selective waste materials are transferred to a secondary conveyor unit, as well as to designated containers, hoppers or bins that are operably connected to a respective sorting station. The secondary conveyor unit includes a secondary sorting conveyor and a secondary return conveyor and at least one secondary sorting station, whereby designated waste materials from the secondary sorting conveyor are removed and transported to more specific designated containers, hoppers or bins.

12 Claims, 8 Drawing Sheets

APPARATUS AND METHOD FOR SORTING COMMINGLED WASTE MATERIALS FOR RECYCLING

BACKGROUND OF THE INVENTION

1. Field of the Invention

The present invention relates generally to an apparatus for processing of waste materials and more particularly to a new method of processing waste materials for selective recycling, wherein the recyclable materials consist of all forms and grades of paper, plastic, glass, metal and wood. The method includes the employment of a closed-loop conveyor system having a primary sorting conveyor unit and a plurality of secondary sorting units operably interconnected to the primary sorting conveyor unit, and wherein a multiplicity of work stations are positioned within the closed-loop conveyor system for the removal of selective waste materials so as to be transported to respective designated storage areas or bins.

2. Description of the Prior Art

As is well known in the art, various problems and difficulties are encountered in providing suitable means of separating mounds of conglomerated waste material in a fast, simple, and accurate manner so as to establish a cost-effective method of retrieving recyclable materials.

There are at present several methods of collecting and separating waste materials. Most methods today include what is known as curbside collection. This requires homeowners to do the preliminary separating of glass items, cans, plastic, metal, and paper material. Participation time is required for sorting, setting out, and to retrieving containers. The homeowner is provided with a variety of storage containers. Generally, the largest container offered is often too small to accommodate the items. The containers are usually color coded, so as to store the selected waste materials in their properly designated container as required by the waste-disposal company.

However, this type of curbside collection recovers only a small percentage of the discarded materials. It is well understood in the industry that the prime rule of material recovery is separation of designated waste material. This means that a different waste material is not to be intermingled with another. That is, the more intermingled the waste material the more costly the handling. Thus, the higher the cost, the lower the monetary award becomes. Over a period of time many collection operations become economically unfeasible. Compartmentalized vehicles have been tried, but the cost is exorbitantly high. Thus, it can be understood that other more suitable means must be provided to solve the great number of existing problems.

As examples of some of the many other problems, different colored glass bottles must be further sorted into color bins, and various types of paper must be classified for separation. That is, newspapers, magazines, grocery bags, cartons, boxes, phone books, catalogs, junk mail, etc., should be separated. This is also true for all types of metals, plastics and other valuable materials, such as found in auto and appliance parts, batteries and oil. The recovery of these and many more waste products are not generally provided for because of the time, cost and the lack of know-how to make their separation feasible. At present large amounts of recyclable material still go to landfills, and are thus lost to the recycling process.

However, recently the trend is in the direction of providing materials-recovery facilities. These facilities are generally established in large plants that are designed to accommodate the processing of large amounts of commingled recyclables. Yet, these plants accomodate a limited number of material types and require relatively clean materials, such as glass bottles previously separated from the waste material.

Known recycling systems that are presently in use are designed having open-end sorting arrangements, such as employed by the Bollegraaf Sorting System. This system uses an in-floor conveyor that feeds waste material to an elevating conveyor that transports the material to an elevated picking conveyor. A multiplicity of sorting stations are located along the picking conveyor, whereby a limited number of waste material types are individually sorted by a worker and deposited in respective chutes so as to be transported to assigned storage bins, hoppers or compactors. Thus, all waste material together with the missed recyclable material that is left on the elevated conveyor is taken to the terminating end of the conveyor and deposited into a bin or transporter. All of this waste material is then sent to a waste dump which is generally referred to as a landfill.

As of now, there is no waste recycling facility or plant that provides a sorting system to solve many of the costly separation and recycling problems that have been herein mentioned. Recycling programs of significant size are presently implemented by operators who have developed their systems and equipment with the emphases on the quantity rather than the quality of the waste material. Until now, there has not been developed a technology to provide a high-yield, high-profit recovery system as will hereinafter be described and claimed.

SUMMARY AND OBJECTS OF THE INVENTION

The present system operates in cooperation with collection vehicles that pick up the waste material, which is referred to as post-consumer recyclable materials consisting of all forms and grades paper, plastic, glass, metal and wood.

Newspapers, corrugated paper, oil and wood are packed separately in the vehicle during collection and are unloaded in their appropriate receiving areas at the materials recovery facility.

All other materials, comprising approximately 80% of each pick-up, are loaded and commingled into the vehicle dumping box and are unloaded into receiving bunkers when delivered at the facility. The commingled materials are then transferred to a main-input conveyor unit located on the ground floor of the facility for inspection and rough-sorting. At this time, hazardous items, large items (over 1 ft. sq.), and all assembled items, consisting of more than one material type, are removed.

Accordingly, sorters are stationed at ground level sorting areas and are assigned to remove all hazardous and large materials such as corrugated materials, wood, box-board, glasses, plastics, metals and the like that exceed ten to twelve inches or more. The removal of these items assures worker safety as well as an easier recognition of smaller materials that are transferred and assigned to respective primary sorting stations which are located at staggered positions along both sides of an upper level primary sorting unit. The primary sorting unit traverses the entire length of the mezzanine at a height suitable for hand-sorting and consists of a primary sorting conveyor and a primary return conveyor which define a closed loop system. The primary sorting conveyor is operably connected to several secondary conveyor units that include secondary sorting conveyors and secondary in-line return conveyors, each consecutively feeding onto the next.

Primary sorting stations are placed at staggered positions along both sides of the primary sorting conveyor. Each primary sorting station is assigned to receive designated items from the commingled materials as they travel along the primary sorting conveyor so as to transfer the selected materials to one of several secondary conveyor sorting units, which in itself includes a closed loop arrangement and at least one secondary sorting station. Unwanted items are returned to the primary sorting conveyor by means of a primary return conveyor where they are again transported back to an appropriate primary sorting station.

Accordingly, it is an important object of the present invention to provide an apparatus and method of recycling waste materials that establishes a high-yield, high-profit recovery system which has been heretofore unobtainable in the industry, wherein the basic configuration of the present recycling recovery method includes a primary closed-loop conveyor unit together with a plurality of secondary closed-loop conveyor units to insure a 100% sorting efficiency.

Another object of the present invention is to provide a system and method of recycling waste materials, wherein the closed loop configuration prevents waste materials from being lost due to the constant recirculating of missorted items, whereby the item will repeatably pass each primary sorting station that is located along the primary sorting conveyor.

Still another object of the invention is to provide a method of recovering recyclable waste materials having a system that allows for the sequential removal of specific designated items. First to be removed would be those items that impair visibility, thereby maximizing a sorter's visibility, safety, and accessibility to smaller waste-material types. The sequential removal of designated items at each station establishes a means for readily recognizing specific groups of materials by shapes, colors and textures.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts, in which.

DETAILED DESCRIPTION OF THE INVENTION

Figure 1:
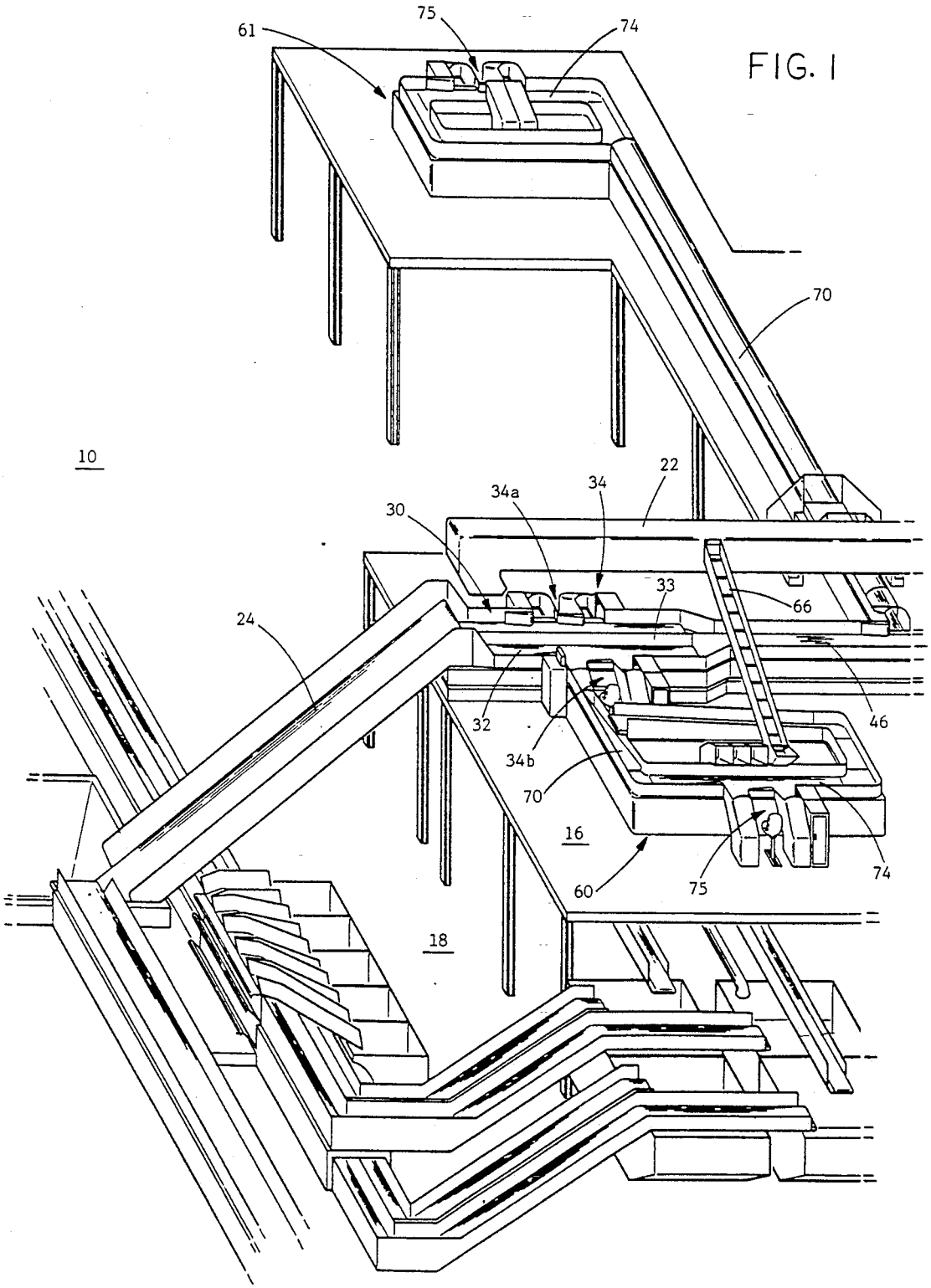
FIGS. 1, 1A, and 1B are pictorial views of the invention, wherein there is shown a waste-material sorting facility having the overall sorting system located therein including the sequential arrangement of the primary closed-loop sorting unit and the interconnected secondary closed-loop sorting units, and their respective designated sorting stations.
Figure 1A:
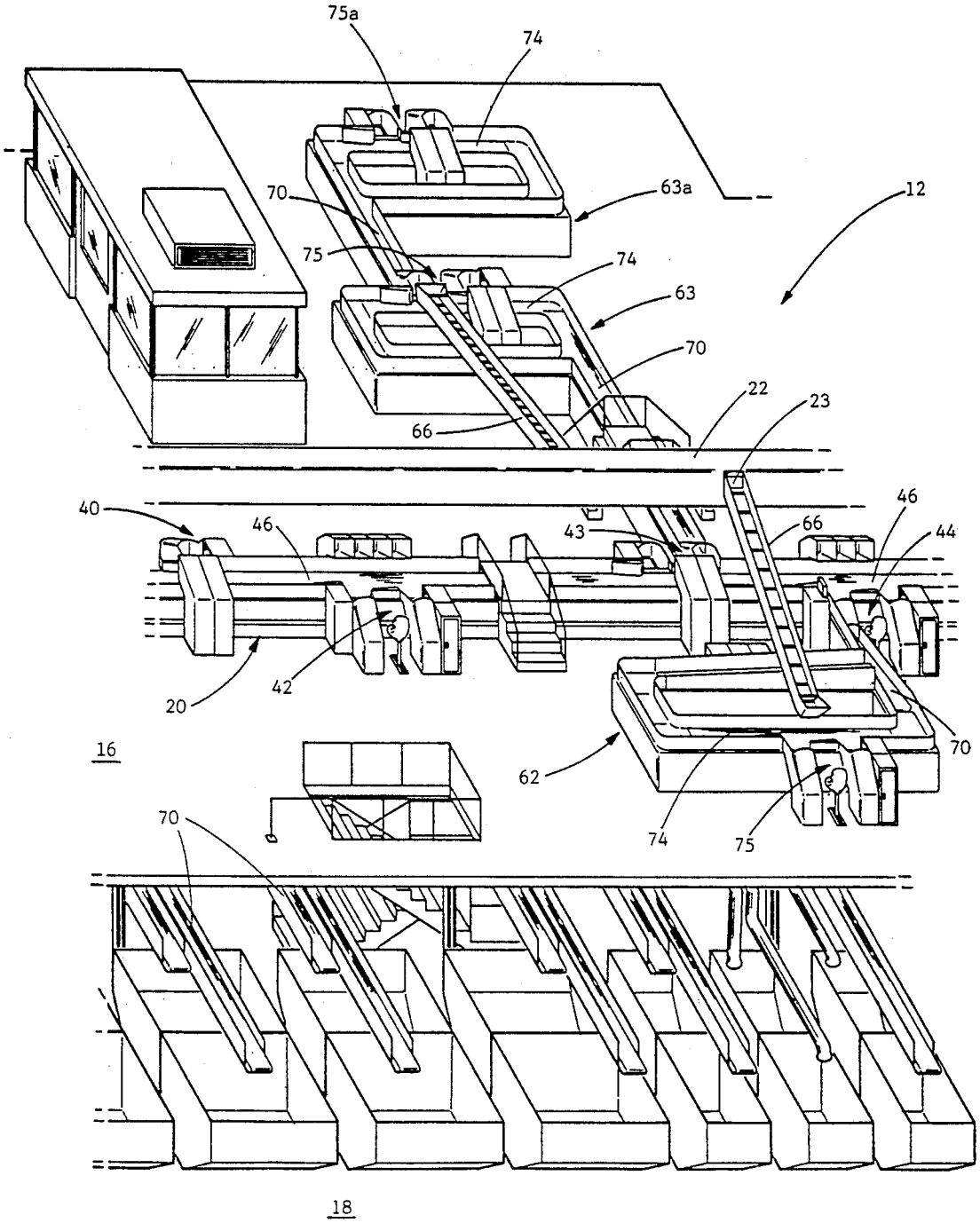
Figure 1B:
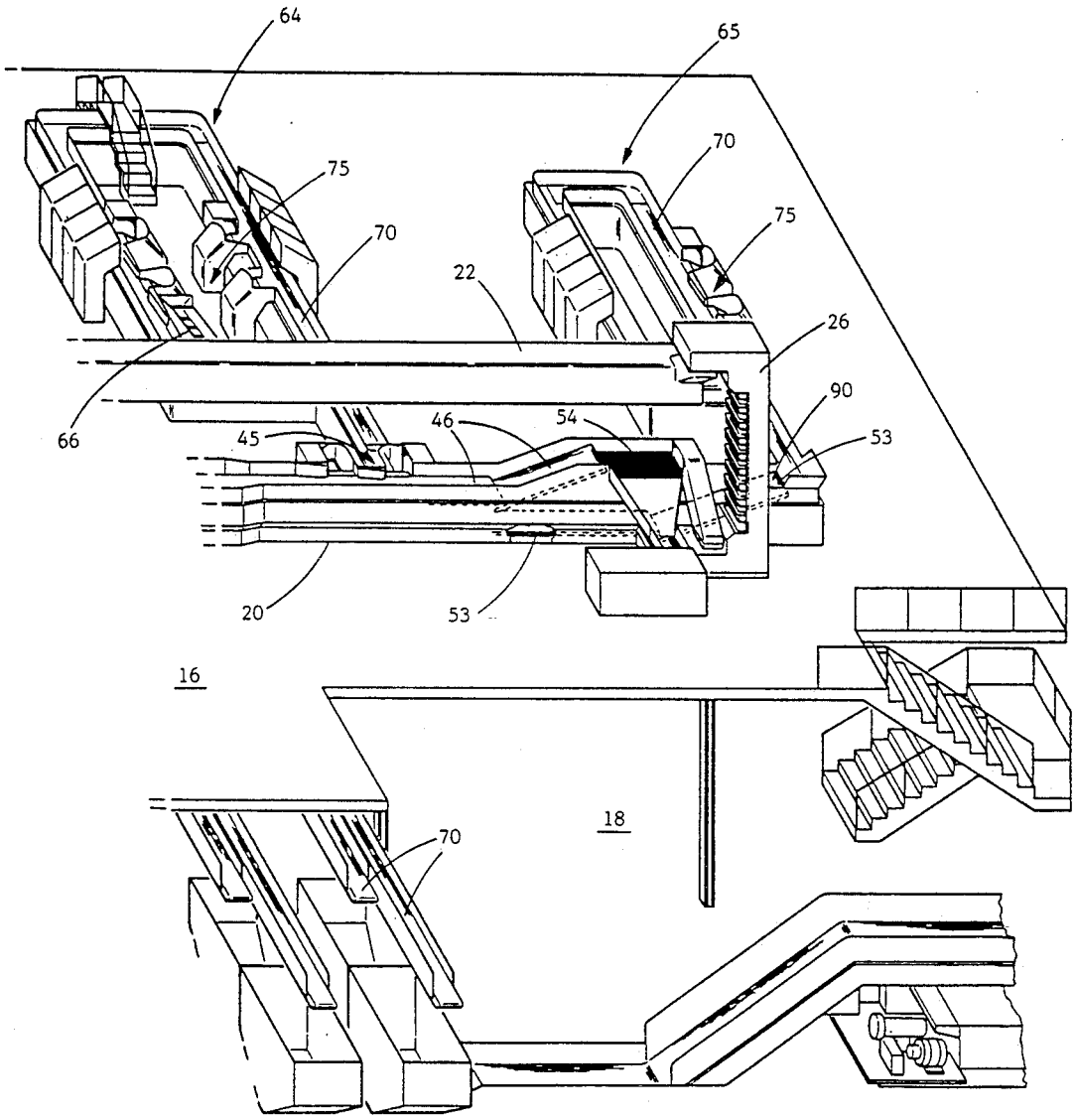

Referring more particularly to FIGS. 1, 1A, and 1B, there is illustrated a pictorial view of a waste-material recycling facility, generally indicated at 10, having a waste sorting system, designated generally at 12, and positioned within facility 10 so as to readily receive waste materials for recycling. The waste sorting system is specifically arranged to sequentially recover selective items found among the commingled waste materials. These waste materials (not shown) are supplied by suitable route-collecting vehicles that are well known in the industry for picking up commingled recyclable waste materials. The commingled materials generally consist of various paper products, plastics, glass of all types and colors, as well as wood and metal items that are commonly collected from residences and businesses in specified areas.

After the commingled waste items are collected by the vehicles, the material is delivered to the recycling facility 10 where it is unloaded and positioned to be received by the sorting system 12. Sorting system 12 basically comprises a closed-loop primary transport means that is defined by a primary conveyor unit 14. The primary conveyor unit 14 is located on a mezzanine floor 16 which is positioned above the ground floor 18. Primary conveyor unit 14 comprises a primary sorting conveyor 20 and a primary return conveyor 22, each of which is arranged to communicate with the other at their opposite ends so as to define a closed loop transporting circuit. Primary sorting conveyor 20 receives all commingled materials at the entrance thereof by means of a main elevating conveyor 24. Conveyor 24 extends upwardly from ground floor 18 to mezzanine floor 16, whereby the materials are transferred to primary sorting conveyor 20 which extends the entire length of the mezzanine at a height suitable for hand-sorting. The primary sorting conveyor consists of several in-line conveyor belts, each consecutively feeding material onto the next. The belts vary in length and width to accommodate for the composition and quantity of the different material components as they progress through the manual take-off sequences. The final belt 54 of the primary sorting conveyor 20 terminates into a vertical bucket conveyor 26 which elevates all remaining materials that were overlooked or missed during the first sorting pass, and feeds it onto the enclosed overhead primary return conveyor 22. Primary return conveyor 22 is defined by belt 23 that travels in the opposite direction from that of the primary sorting conveyor 20, thereby returning and depositing remaining materials at the point of entry of the commingled materials. Thus, together the primary sorting conveyor 20 and the return conveyor 22 form a closed-loop circuit of the primary conveyor unit 14.

Figure 2:
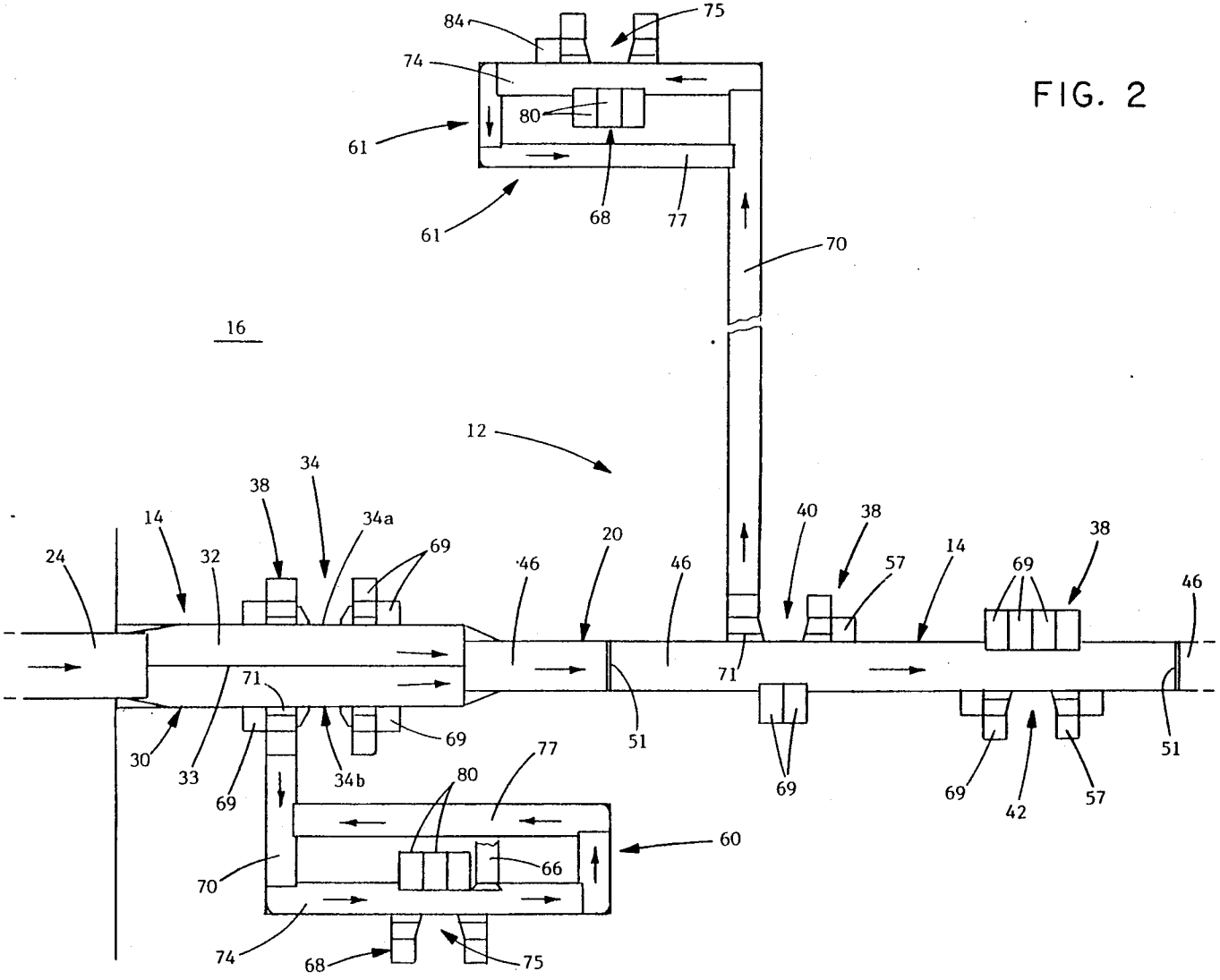
FIG. 2 is a schematic top plan view of a receiving portion of the recycling system as shown in FIG. 1.

The primary sorting conveyor 20 includes a material feeding end or receiving entrance defined by an elevating conveyor 24, which comprises a dual-input conveyor means, generally indicated at 30, and is formed by a conveyor 32 having a belt formed with an enlarged width or by a pair of conveyor belts separated by an elongated partition 33. Partition 33 provides a means for first separating incoming material. (See FIGS. 1 and 2.) A first sorting station 34 is located at the entrance of the conveyor system and is defined as having dual sorting areas, as indicated at 34*a* and 34*b*. Accordingly, the incoming materials are divided as they pass before sorting areas 34*a* and 34*b* of the first sorting station 34. This arrangement causes the waste materials to directly pass before manual sorters (workers) 35 and 36. Sorters 35 and 36 are assigned to the respective sorting areas 34*a* and 34*b*, which are positioned on opposite sides of conveyor 32, wherein each sorter removes his assigned materials for further distribution.

Figure 5:
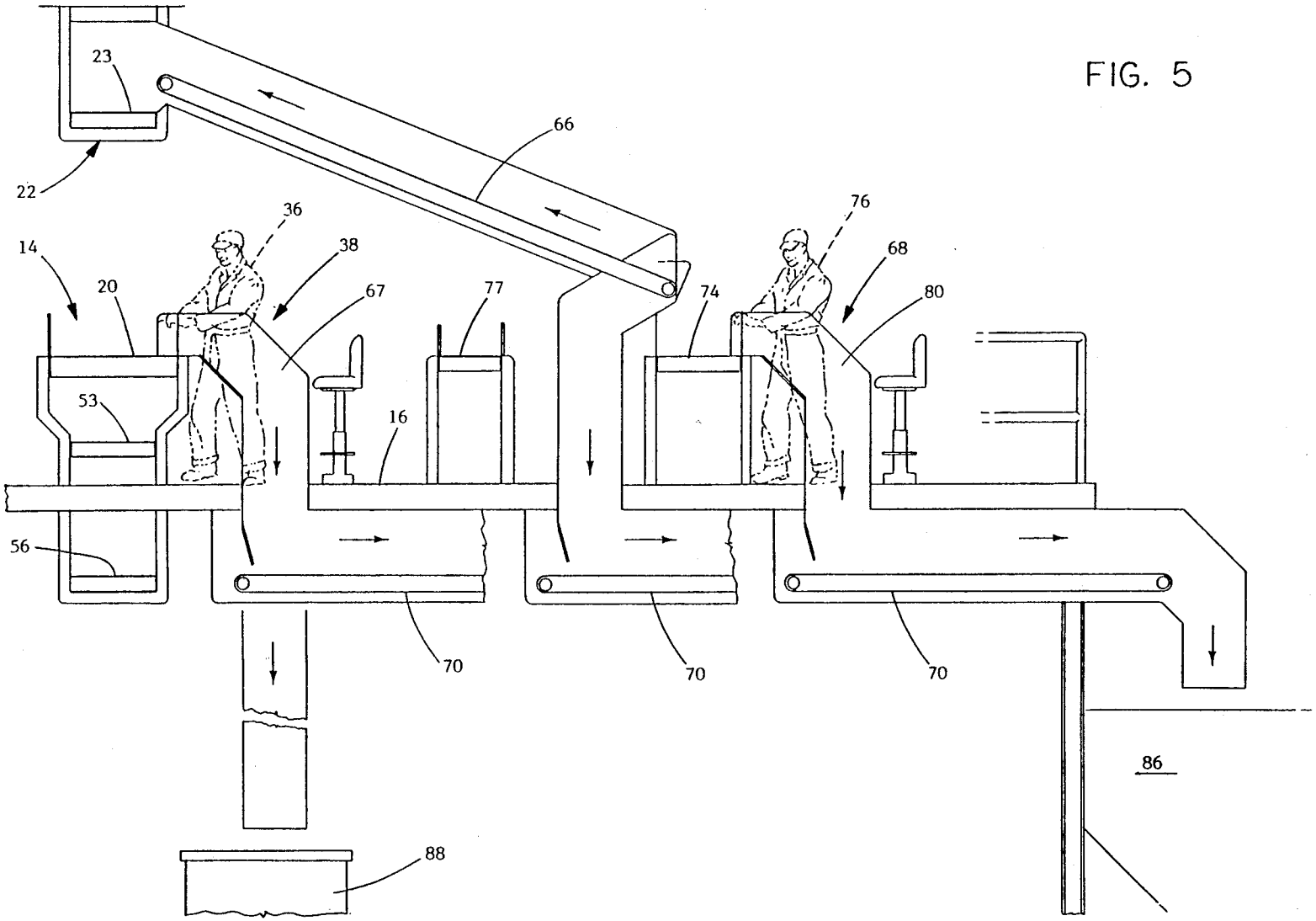
FIG. 5 is a schematic cross-sectional view taken substantially on line 5—5 of FIG. 4.

At this time, it is important to note that the waste materials are removed from the primary sorting conveyor in a sequentially selective operation so as to provide maximum safety, material visibility, recognition and accessibility of the various materials as they pass through each sequentially positioned sorting station. Each primary transfer outlet means 38 comprises a plurality of primary sorting stations 40, 42, 43, 44, and 45, which will hereinafter be described in more detail. The primary sorting conveyor 20 is formed by a plurality of in-line conveyor belts 46, each conveyor belt 46 being arranged to feed the waste materials onto the next succeeding belt. These belts vary in length and width so as to accommodate for the different materials, their component composition and quantity as they progress through the manual take-off or removal sequences. The final in-line belt 54 terminates at vertical bucket conveyor 26 which elevates all the remaining materials onto a closed overhead return conveyor unit 22. It should be noted that at several locations, as the materials move from one belt to another, they flow over magnetic separator drums, such as indicated at 51. This allows for all ferrous materials to be automatically extracted so as fall onto a ferrous belt 53 that is located below the primary conveyor system, as illustrated in FIG. 5. Ferrous belt 53 carries ferrous components to a ferrous sorting station 65. A landfill materials conveyor 56 is also shown in FIG. 5 as being an enclosed belt that is suspended under ferrous belt 53. Landfill conveyor 56 provides for the transporting of waste materials that are considered not recyclable. This belt is loaded by means of landfill sorting chutes 57 that are located at each of the respective sorting stations and terminates at the landfill transport roll-off bin.

Figure 2A:
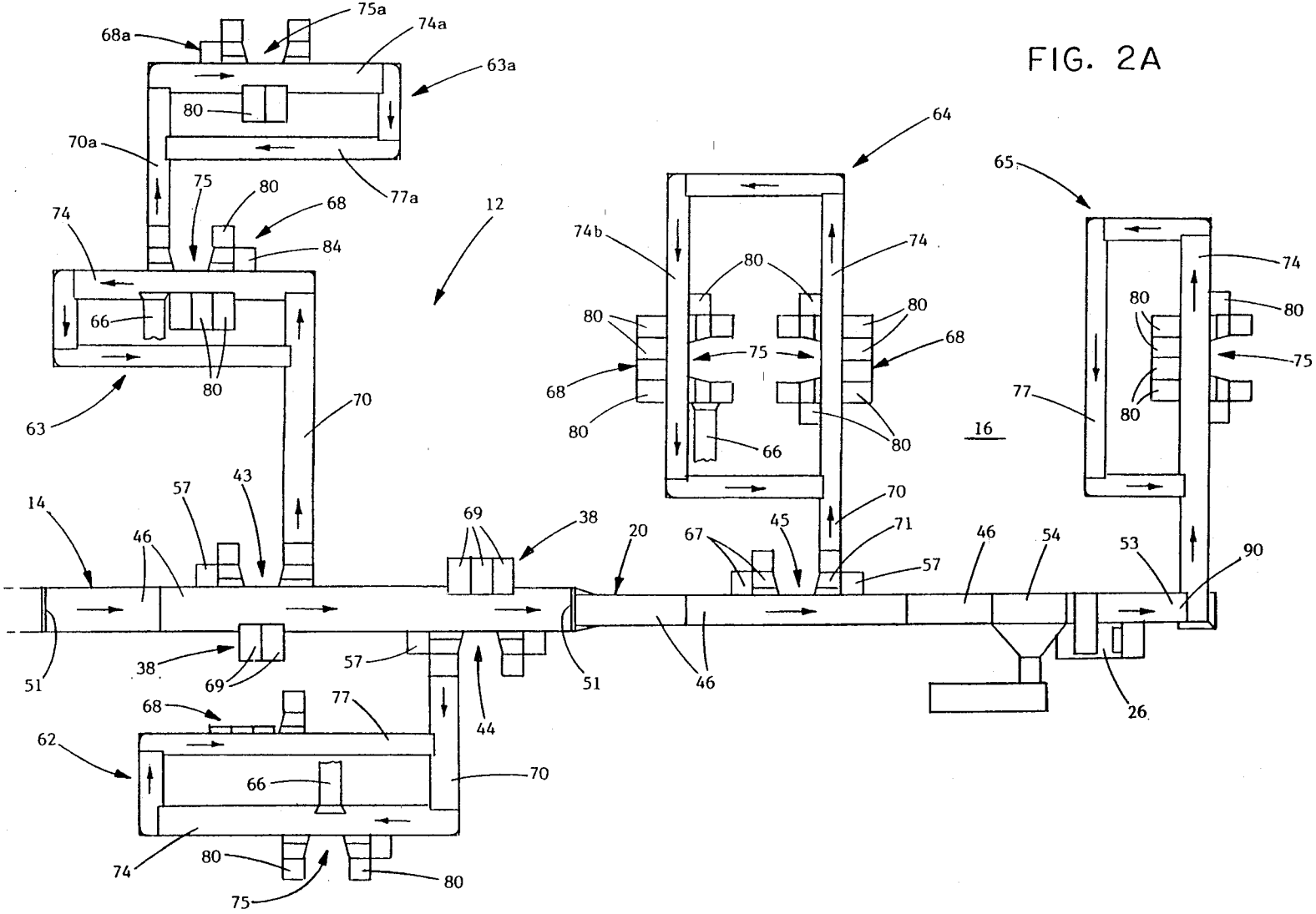
FIG. 2A is the second portion of the top plan view of FIG. 2, wherein there is shown the additional several secondary closed-loop sorting units.

In FIG. 2A, there is shown, adjacent the terminating end of primary conveyor 20, a small parts separator belt defined by a suitable screen conveyor belt 54.

Figure 3:
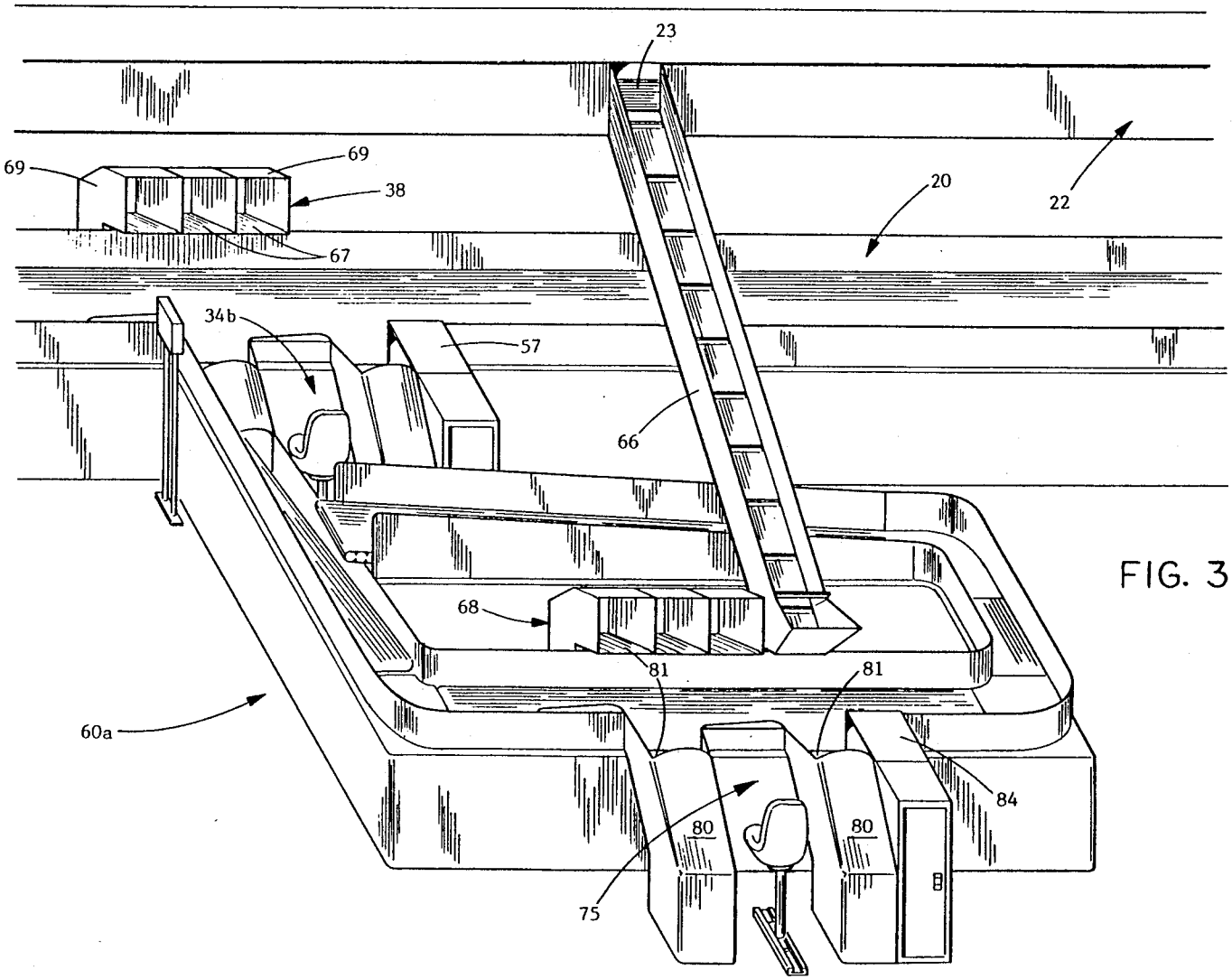
FIG. 3 is a pictorial view of a typical secondary closed-loop sorting unit interconnected to the primary return conveyor by means of a station-return conveyor.
Figure 4:
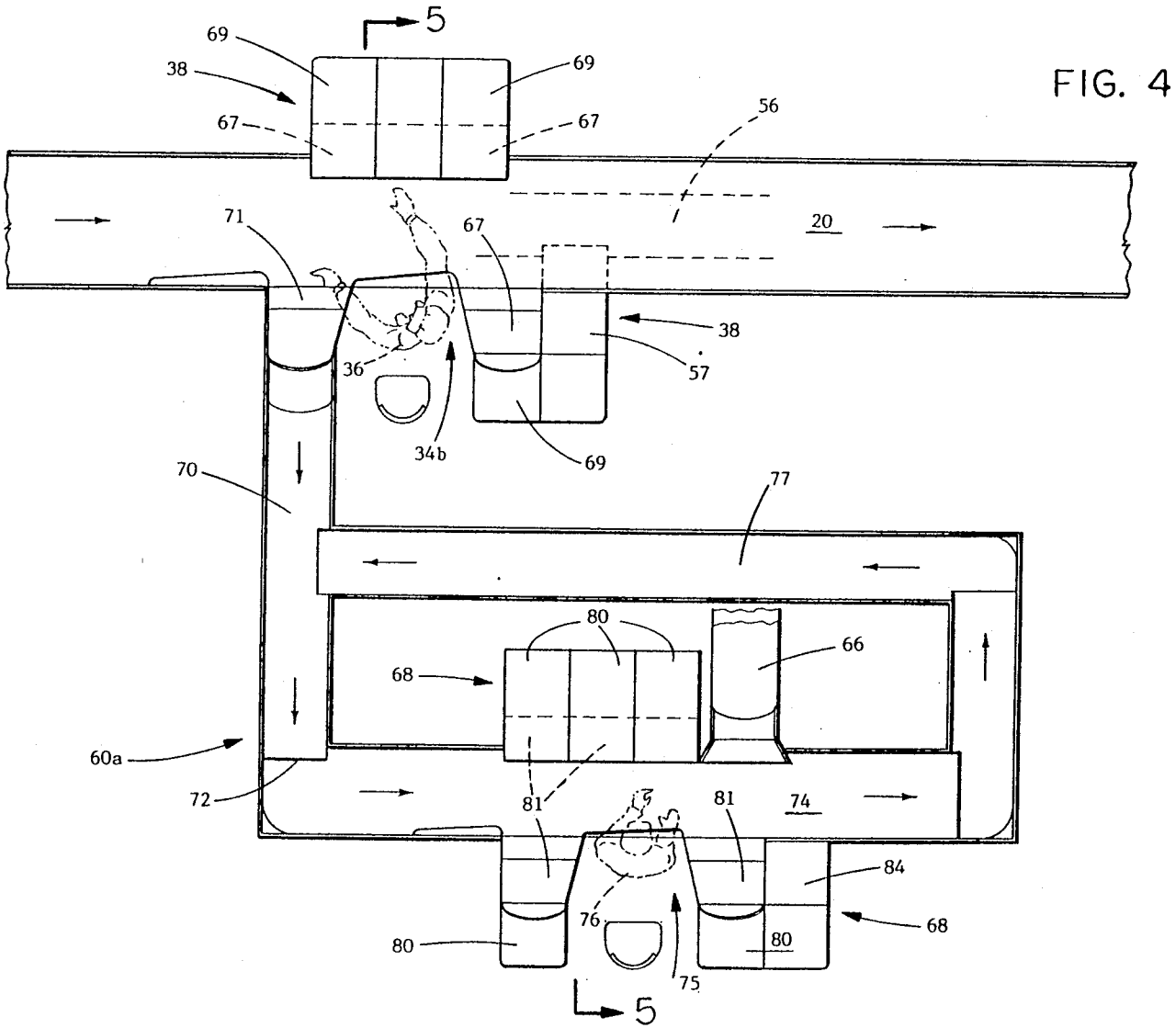
FIG. 4 is a top plan view of a typical secondary closed-loop sorting unit as depicted in FIG. 3.

Primary sorting stations 34, 40, 43, 44 and 45 all directly communicate with respective secondary closed-loop sorting units 60, 61, 63, 62 and 64 which are basically arranged in a manner as illustrated in FIGS. 3, 4 and 5. It should be noted that secondary closed loop sorting unit 63 is also provided with an auxiliary closed loop sorting unit, indicated at 63*a*. The terminating end 90 of ferrous conveyor 53 communicates with a last secondary closed loop sorting unit 65 which does not include a primary sorting station.

The auxiliary sorting unit 63*a* is formed having a transfer conveyor 70*a*, sorting conveyor 74*a*, a return conveyor 77*a*, and a sorting station 75*a* defined by transfer outlet means 68*a*.

Secondary sorting unit 64 includes two sorting conveyors 74 and 74*b*, each being provided with a sorting station 75, both sorting stations having respective transfer outlet means 68, as illustrated in FIG. 2A.

The pictorial view of FIG. 3 and top plan view of FIG. 4 illustrate a typical arrangement of generic operational components for sorting and transferring selective waste materials. The primary sorting station is indicated as 34*b* and secondary sorting stations is indicated as 75. In particular, FIG. 3 includes a complete arrangement of components including a station-return conveyor 66 that is positioned between the secondary closed-loop sorting unit 60*a* and the overhead primary return conveyor 22. Primary sorting station 34*b* is positioned along primary sorting conveyor 20 and includes transfer outlet means 38. Transfer-outlet means 38 is defined by a plurality of chutes 67 and chutes 69 which are assigned to receive selective materials. Chute 57, as seen in FIG. 4, is shown communicating with landfill conveyor 56, indicated in dotted lines under conveyor 20. An assortment of secondary outlet sorting means 68 are also provided and are positioned along each side of secondary conveyor belt 74.

The generic secondary unit 60*a*, as does each secondary sorting unit 60 through 64, includes a transfer conveyor 70 that has at one end an opening 71 which communicates with primary sorting conveyor 20 and an opposite terminating end 72 that allows the incoming material to be transferred to secondary sorting conveyor 74. Sorting conveyor 74 includes a typical secondary sorting station 75 defined by secondary outlet sorting means 68. Materials that are missed by sorter 76 (FIG. 4) are returned back to secondary sorting conveyor 74 by means of a station-return conveyor 77. Secondary outlet sorting means 68 are arranged having a plurality of sorting chutes 80 which are positioned on each side of the sorting conveyor 74. Chutes 80 and slides 81 are positioned so as to allow sorter 76 to quickly and safely push the selected material into any one of the easily reached chute openings. Each chute 80 is designated for a particular type of material including a chute 57 which is adapted to receive landfill waste material. Landfill material is that material which can not be recycled and must be sent to a landfill dump. It should be noted that almost all secondary sorting stations have access to a landfill belt 56 and to a return conveyor 66 for recirculating material back through the primary sorting closed loop conveyor unit 14.

FIG. 5 illustrates a schematic cross-sectional view of the typical combination of primary and secondary sorting units, wherein primary sorter 36 is shown at his position adjacent the primary sorting conveyor 20 and the secondary sorter 76 is positioned adjacent the secondary sorting conveyor 74 as described above. Under the primary conveyor is ferrous transport conveyor 53 and under the ferrous conveyor is positioned landfill conveyor 56, as mentioned heretofore. Thus, it can be seen that each chute is arranged to cooperate with a respective transfer conveyor 70, whereby the designated waste material for each chute is transferred to a respective hopper or suitable container, such as hopper 86 or container 88. Transfer conveyors 70 transport selective materials to assigned bins, containers and hoppers for accumulation and are then moved in bulk for baling flattening, granulation or loading into shipping containers for distribution.

Accordingly, sorter personnel stand and/or sit at their work station which is designed for convenient reaching access to the conveyed incoming materials and to the segregation chutes and conveyors to which the materials are directed. Sorters do not lift each item from the passing conveyor belt because the adjacent chutes and slides are formed having openings and ramps so that the materials are only required to be pushed and slid into the adjacent chutes or onto adjacent conveyors.

The primary sorting stations 34*a* and 34*b* are designated to receive and sort out all boxes, cartons, film sacks, paper sacks, and like materials. All boxes are directed from stations 34*a* and 34*b* to secondary sorting unit 60 where they are further separated at a secondary station and sent to the respective receiving means, such as bins, containers, or hoppers, as heretofore described. Primary station 40 is designated for sorting and removing all glass products, PET and PVC bottles. These materials are transferred by conveyor to secondary closed-loop sorting unit 61 for detailed separation of various glasses and like materials to their respective receiving means. Downstream of station 40 is primary station 42 where all types of books, including phone books, magazines, catalogs and wood are removed and sent directly to their respective receiving means.

Primary station 43 is designated to remove all plastic materials from primary conveyor 20. Plastic materials are sent to secondary sorting unit 63 by way of transfer conveyor 70, whereby plastics consisting of PVC, PP, PS, and ABS are removed from secondary sorting conveyor 74 so as to be sent by conveyor 70*a* to the auxiliary sorting unit 63*a*, and are then selectively directed to a granulating means. All HDPE plastic bottles are selectively removed by their designated colors, such as red, orange, yellow, green, blue, black, brown, and white which are deposited in designated sorting chutes 80.

Primary station 44 is designated for the selective removal of materials that consist of all ledger paper, computer paper, golden envlopes, manila materials, etc. These materials are placed on conveyor 70 of secondary sorting unit 62 so as to be deposited in proper respective chutes 80 for transfer to a bale hopper 86 or bale-accumulation container 88. If unwanted material is inadvertently placed on secondary sorting unit 62, it is sent back to the primary conveyor unit 14 by means of return conveyor 66.

Primary station 45 is positioned downstream of primary station 44 and includes secondary sorting unit 64. Chutes 67 and 57 define station 45 in which chutes 67 receive aluminum cans and foil. Landfill material is sorted into chute 57. All non-ferrous metals, such as aluminum, copper, brass, lead, and zinc items, are placed on sorting conveyor 74 so as to pass before two secondary stations 75. Stations 75 are oppositely disposed from each other, wherein their respective chutes 80 are assigned specific items for proper separation and distribution to specific designated receiving means.

The last closed-loop sorting unit 65 is shown as being arranged at the terminating end 90 ferrous conveyor 53, whereby the ferrous items are directly transferred to sorting conveyor 74. Accordingly, a sorting station 75 is located along sorting conveyor 74, as indicated in FIG. 2A, and is defined by a plurality of chutes 80 adapted to receive designated ferrous materials, such as steel cans, metal tools, wire, cast iron, etc., for selective separation and additional processing.

It should be noted that secondary closed-loop sorting unit 65 is shown as being the last secondary sorting unit within the overall sorting system 12. However, it is contemplated that other sorting units can be included within the recycling system as may be needed for additional types of waste material. Further, all secondary stations 75 have a station-return conveyor 66 that communicates with primary return conveyor 22. All stations are also provided with a landfill chute that communicates with one of many landfill belts 56 for transferring materials such as leather, rubber, fabric, aseptic packaging, and inseparable assemblies. Thus, it can be readily seen that the largest possible percentage of recyclable scrap materials are diverted for recycling and are saved from being lost to landfills.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. A method of selectively sorting commingled recyclable waste materials comprising the steps of:

depositing commingled recyclable waste materials on a primary closed-loop conveyor unit;

selectively sorting designated waste materials at respective designated primary sorting stations positioned within said primary closed-loop conveyor unit;

transferring said designated waste materials to assigned receiving means and to assigned secondary closed-loop conveyor units;

selectively sorting designated waste materials at secondary sorting stations located within each of said secondary closed-loop conveyor units; and transferring said selective waste materials from said secondary sorting stations to said assigned receiving means;

said primary closed-loop conveyor unit being defined by a primary sorting conveyor and said corresponding primary materials return conveyor, said primary sorting stations being located along said primary conveyor;

said secondary closed-loop conveyor units being defined by at least one secondary sorting conveyor and at least one secondary return conveyor, wherein said secondary sorting station is positioned along said secondary sorting conveyor;

sequentially removing commingled waste materials according to various types and sizes of the materials;

removing the selective materials; and depositing the materials into designated transfer-inlet means that define said primary and secondary sorting stations, wherein said transfer-inlet means includes a plurality of sorting chutes;

transferring all missed and/or remaining materials left on said primary sorting conveyor to said primary return conveyor, whereby the returning materials are deposited with the commingled material at the entrance of said primary sorting conveyor, and whereby the returning material are continuously passed before the respective primary sorting stations;

extracting ferrous metals by magnetic separators that are randomly located along said primary sorting conveyor;

selectively sorting all boxes, cartons, sacks and like items at designated primary and secondary sorting stations;

selectively sorting all glass items, PVC bottles and related items at designated primary and secondary sorting stations;

selectively sorting all books, catalogs, magazines, and related items at designated primary and secondary sorting stations;

distributing the sorted items into designated sorting chutes for transfer to respective receiving means defined by containers, hoppers and bins of various types; and wherein at least one of said secondary closed-loop conveyor units is provided with an auxiliary closed-loop conveyor unit.

2. A method as recited in claim 1, wherein said transfer means are located between said sorting chutes and said receiving means.

3. Apparatus for selectively sorting recyclable waste materials comprising:

a primary closed-loop conveyor unit having a primary sorting conveyor and a primary return conveyor, whereby waste materials are recirculated within said primary closed-loop conveyor unit for selective sorting;

a plurality of primary sorting stations positioned along said primary sorting conveyor for selectively sorting designated waste materials;

a plurality of secondary closed-loop conveyor units having at least one secondary sorting conveyor and at least one secondary return conveyor, whereby waste materials are recirculated within said secondary closed-loop conveyor units for selective sorting;

at least one secondary sorting station positioned along said secondary sorting conveyor for selectively sorting designated waste materials transferred from said primary sorting conveyor;

means for receiving designated sorted waste materials from said primary and secondary sorting station;

means for transferring the designated sorted waste materials from said primary and secondary sorting stations to said receiving means;

said primary and secondary stations being defined by waste-transfer inlet means;

wherein said waste-transfer inlet means includes a plurality of sorting chutes, each of said sorting chutes being arranged to receive designated waste materials; and wherein at least one secondary closed-loop conveyor unit includes an auxiliary closed-loop conveyor unit.

4. An apparatus as recited in claim 3, wherein each of said secondary closed-loop conveyor units includes a station-return conveyor operably interposed between said secondary sorting conveyor and said primary return conveyor.

5. An apparatus as recited in claim 3, wherein said transfer means comprises a waste-transfer conveyor operably interposed between said sorting chutes and said receiving means, whereby the designated material from each of said sorting stations is deposited in respective designated receiving means.

6. An apparatus as recited in claim 5, wherein said primary conveyor includes a plurality of conveyor belts having magnetic separators interposed therebetween for separating magnetically attracted parts as the parts move along the conveyor belts.

7. An apparatus as recited in claim 3, wherein said receiving means includes containers, hoppers and bins of various types.

8. An apparatus as recited in claim 3, wherein said primary sorting conveyor includes:

an entrance conveyor belt having a centrally mounted longitudinal partition, whereby said entrance conveyor belt is divided into two sections by said partition, and a first and a second primary sorting station, wherein said sorting stations are positioned on opposite sides of said entrance conveyor belt.

9. A method for manually sorting commingled recyclable materials by the use of a system of recirculating closed-loop conveyors arranged in a particular pattern, wherein the steps thereof comprise:

providing manual primary sorting stations positioned about a primary closed-loop conveyor system, whereby the materials are categorized and directed to one of a plurality of secondary closed loop conveyor systems; and providing manual secondary sorting stations arranged about the secondary closed-loop conveyor systems, wherein at least one of said secondary closed-loop conveyor systems includes an auxiliary closed-loop conveyor system, whereby the categorized materials are further sorted into their individual constituents and directed to a selected processing and/or shipping means.

10. A method as recited in claim 9 including the steps of:

automatically transferring missed and/or remaining materials left on said primary closed-loop conveyor system into an elevating vertical bucket conveyor and depositing said missed and/or remaining materials into an enclosed overhead primary return conveyor, whereby returning materials are deposited with the commingled materials at the entrance of said primary closed-loop conveyor system, said missed and/or remaining materials being repeatedly passed before said primary sorting stations.

11. A method as recited in claim 10, including the steps of:

automatically transferring missed and/or remaining materials left on said secondary closed-loop conveyor systems and depositing receive designated waste materials; and wherein at least one secondary closed-loop conveyor unit includes an auxiliary closed-loop conveyor unit.

12. A method as recited in claim 11, wherein missorted materials passing before said secondary sorting stations are returned via a secondary return conveyor to said primary closed-loop conveyor system so that the returning materials are deposited with the commingled materials at the entrance of said primary closed-loop conveyor system, whereby the missorted materials are repeatedly passed before said primary sorting stations.

* * * * *